US007378125B2

(12) United States Patent
Rittmann et al.

(10) Patent No.: US 7,378,125 B2
(45) Date of Patent: May 27, 2008

(54) METHOD FOR SCREEN PRINTED LACQUER DEPOSITION FOR A DISPLAY DEVICE

(75) Inventors: Brian D. Rittmann, Livermore, CA (US); Olof M. Trollsas, Los Gatos, CA (US); Kris E. Sahlstrom, Santa Cruz, CA (US); Sopheak P. Sam, San Jose, CA (US)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/001,084

(22) Filed: Oct. 31, 2001

(65) Prior Publication Data

US 2003/0082304 A1 May 1, 2003

(51) Int. Cl.
*B05D 5/06* (2006.01)

(52) U.S. Cl. ..... 427/68; 427/282; 427/404; 427/421.1; 427/356; 427/372.2

(58) Field of Classification Search ..... 427/68, 427/282, 404, 421.1, 356, 372.2, 66
See application file for complete search history.

(56) References Cited

U.S. PATENT DOCUMENTS

| | | | | |
|---|---|---|---|---|
| 3,582,390 | A * | 6/1971 | Saulnier | 427/69 |
| 4,196,015 | A * | 4/1980 | Lopez | 106/287.24 |
| 4,651,053 | A * | 3/1987 | Kato et al. | 313/466 |
| 5,050,035 | A * | 9/1991 | Hegner et al. | 361/283.4 |
| 5,352,478 | A * | 10/1994 | Miyake et al. | 427/68 |
| 5,660,875 | A * | 8/1997 | Muchi et al. | 427/64 |
| 5,895,692 | A * | 4/1999 | Shirasaki et al. | 427/557 |
| 6,126,988 | A * | 10/2000 | Drumm | 427/64 |
| 6,135,841 | A * | 10/2000 | Mackey | 445/52 |
| 6,368,897 | B1 * | 4/2002 | Jiang et al. | 438/118 |

* cited by examiner

*Primary Examiner*—Timothy Meeks
*Assistant Examiner*—James Lin
(74) *Attorney, Agent, or Firm*—Ladas & Parry LLP

(57) ABSTRACT

The present invention is a method for screen printed lacquer deposition for a display device comprising aligning a mask on top of a faceplate of the display device. Next, the present invention deposits a lacquer material above the mask. Then, the present invention performs a screen printing process to apply the lacquer material through the mask and onto the faceplate to form a lacquer layer on the faceplate. Finally, the present invention dries the lacquer layer.

2 Claims, 16 Drawing Sheets

800

100

100

100

300

700

800

800

800

800

METHOD FOR SCREEN PRINTED LACQUER DEPOSITION FOR A DISPLAY DEVICE

FIELD OF THE INVENTION

The field of the invention relates to the manufacture of display devices. More specifically, the present invention pertains to producing a lacquer layer in the manufacture of display devices.

BACKGROUND OF THE INVENTION

For over 30 years, companies have searched for ways to construct a thin, low-power version of the conventional cathode ray tube (CRT). These efforts have led to a number of flat panel display technologies. None, including liquid crystal displays (LCDs) have met all of the needs for improved power, brightness, efficiency, video response, viewing angle, operating temperature, packaging, full color gamut, ruggedness, and scaleability.

Among the obstacles encountered in fabricating thin cathode ray displays is the deposition of a lacquer layer on the faceplate of the display prior to adding an aluminum layer. The aluminum layer is used to act as a mirror behind each sub-pixel in the display faceplate to reflect the light photons back toward the phosphors of the display screen to create a brighter image. Surface irregularities in the aluminum layer scatter these photons and reduce the efficiency of the aluminum layer in reflecting light to the phosphors, thus degrading the brightness of the display. The lacquer layer provides a supporting structure when the aluminum layer is deposited so that the aluminum layer is deposited upon an even surface and will reflect light evenly toward the phosphors.

One method of depositing the lacquer layer is known as a "float lacquer" process. FIGS. 1A-C are cross section views showing the steps in a prior art float lacquer process 100. In FIG. 1A, a faceplate 101 is submerged in a solvent 102. In FIG. 1B, a thin layer of lacquer 103 is deposited or floated on top of solvent 102. The solvent is then drained from the tank and, as the solvent level subsides, lacquer layer 103 is deposited upon faceplate 101. In FIG. 1C, the level of solvent 102 in the sub-pixels 104 of faceplate 101 is then further reduced by evaporation and an aluminum layer is deposited directly on top of lacquer layer 103. If the aluminum layer were to be deposited directly upon the phosphor rocks within sub-pixels 104, it would conform to the surface of the phosphor rocks and have a very irregular surface which would reflect light back to the phosphor rocks unevenly. During a subsequent baking operation, the remnants of lacquer layer 103 are removed as they can cause phosphor degradation if it remains.

The float lacquer process, however, is time consuming and is vulnerable to operator error. The amount of time it takes to set up the float tank and allow the solvent to become still enough to deposit lacquer layer 103 means the process is not well suited to larger scale manufacturing processes. Additionally, there can be variations in lacquer layer 103 as large as 30% using the float lacquer process, resulting in an irregular aluminum surface. This causes a nonuniform screen appearance and degrades the efficiency and brightness of the display.

The structure of thin CRTs limits the choice of lacquers in a float lacquer process to soft materials with very high elongation. High elongation is necessary to obtain a scaffold for the reflective aluminum to be applied without "tenting" over the rows and columns between pixels. Tenting can be caused by an excessive amount of lacquer on the faceplate which makes the surface of the aluminum balloon and rupture when the lacquer and remaining solvent is baked out. Tenting can be detrimental, not only to the faceplate, but also during final assembly when support structures, inserted to provide greater structural integrity, can cause the aluminum layer to break which leads to electrical arcing in the finished display assembly. Tenting causes non-uniform screen appearance and reduced efficiency and brightness.

Materials with high elongation are also soft materials, which means that the lacquer layer will be very conformal around the phosphor in the sub-pixels. In FIG. 2, a highly conformal lacquer layer 201 has been deposited upon a layer of phosphor rocks 202 contained in a sub-pixel 203. An aluminum layer deposited upon this lacquer layer will take on the shape of the conformal lacquer layer during the subsequent baking step to remove the lacquer layer and any remaining solvents. This causes the aluminum to also take on an irregular shape which reduces the reflectivity of the aluminum layer and can cause a grainy appearance in the display due to bad uniformity. To smooth the aluminum, a thicker lacquer layer (>1μ in thickness) is usually deposited on a regular CRT. Due to the lower voltages used in a thin CRT, a thinner layer of aluminum is necessary to prevent excess electron energy loss. However, this thin aluminum layer is susceptible to blistering and breakage during the bake out if the lacquer layer is greater than 1μ in thickness. In summary, using a thin lacquer layer creates an excessively conformal aluminum layer and using a thicker lacquer layer leads to tenting and rupturing of the aluminum layer.

Accordingly, the need exists for a method of producing a non-conformal lacquer layer for a display device which will result in a smooth, highly reflective aluminum layer that is electrically and mechanically robust. It is also desirable that this method, while meeting the above stated needs, should be applicable to large scale manufacturing processes.

SUMMARY OF THE INVENTION

The present invention is a method for screen printed lacquer deposition in a display device which will result in a smooth, highly reflective aluminum layer that is electrically and mechanically robust. Furthermore, the present invention, while meeting the above stated need, is applicable to large scale manufacturing processes.

The present invention is a method for screen printed lacquer deposition for a display device comprising aligning a mask on top of the faceplate of the display device. Next, the present invention deposits a lacquer material above the mask. Then, the present invention performs a screen printing process to apply the lacquer material through the mask and onto the faceplate to form a lacquer layer on the faceplate. Finally, the present invention dries the lacquer layer.

These and other advantages of the present invention will become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrate embodiments of the present invention and, together with the description, serve to explain the principles of the invention.

Unless specifically noted, the drawings referred to in this description should be understood as not being drawn to scale.

DETAILED DESCRIPTION OF THE PREFERRED EMBODIMENTS

Reference will now be made in detail to the preferred embodiments of the present invention, examples of which are illustrated in the accompanying drawings. While the present invention will be described in conjunction with the preferred embodiments, it will be understood that they are not intended to limit the present invention to these embodiments. On the contrary, the present invention is intended to cover alternatives, modifications and equivalents, which may be included within the spirit and scope of the present invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well-known methods, procedures, components, and circuits have not been described in detail so as not to unnecessarily obscure aspects of the present invention.

Figure 1A:
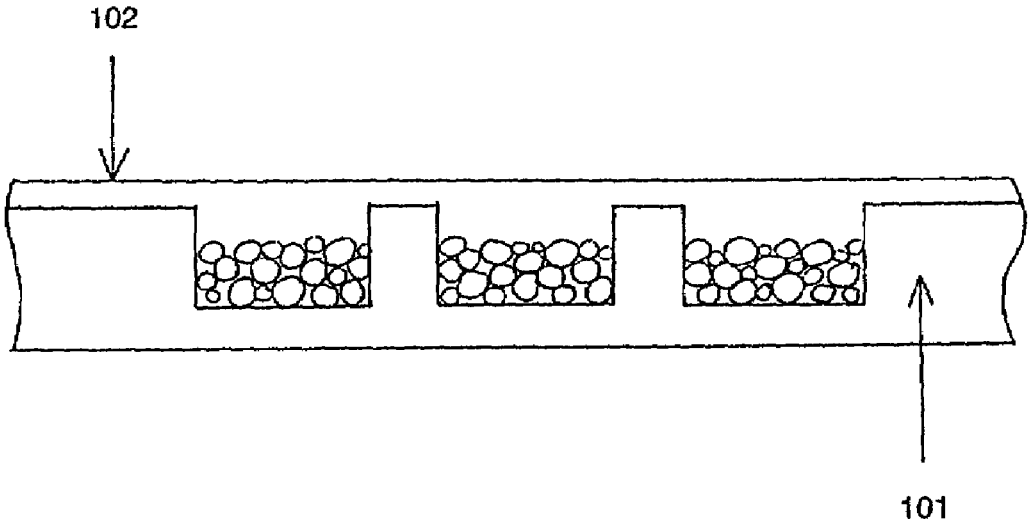
FIGURE 1A (PRIOR ART)
FIGS. 1A-C are cross section views of a display pixel area during a prior art lacquer layer deposition.
Figure 1B:
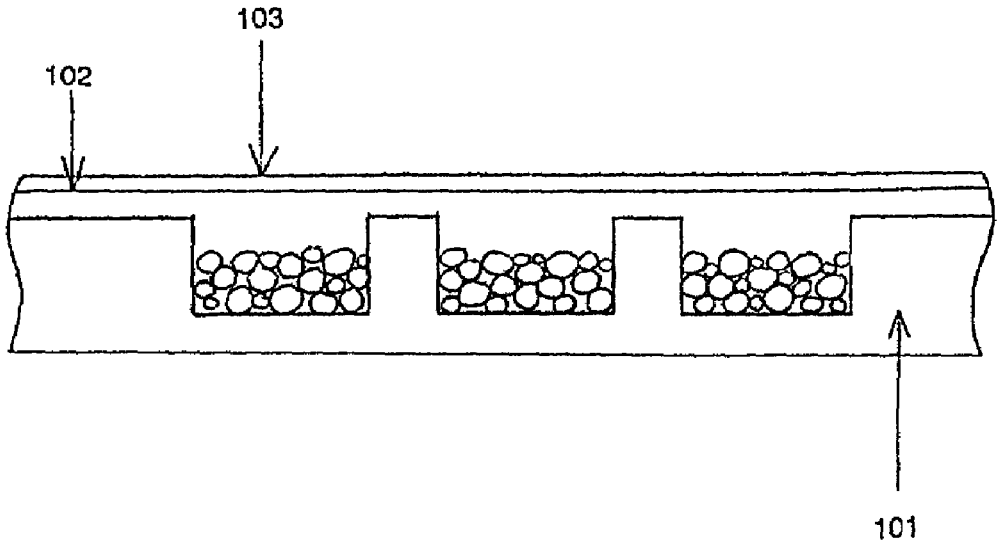
FIGURE 1B (PRIOR ART)
Figure 1C:
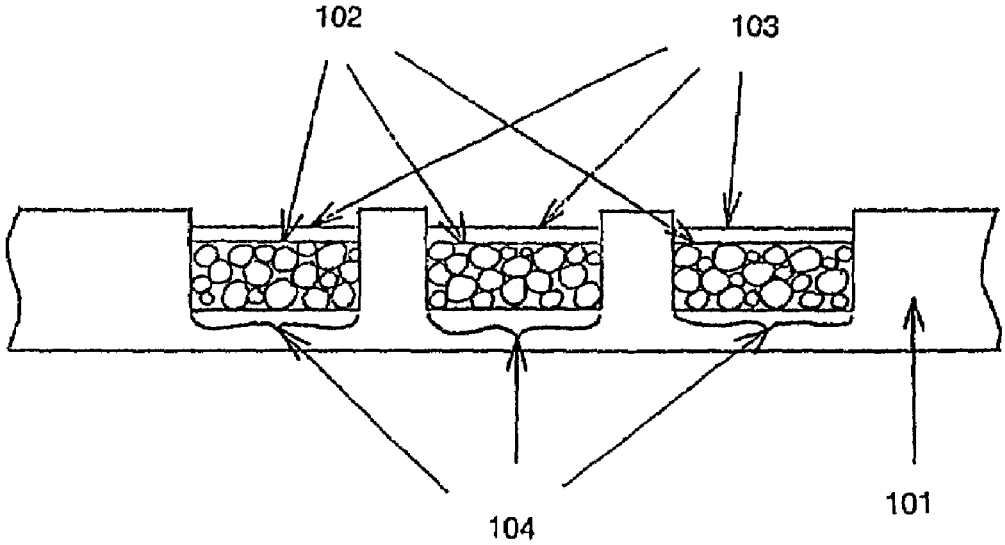
FIGURE 1C (PRIOR ART)
Figure 2:
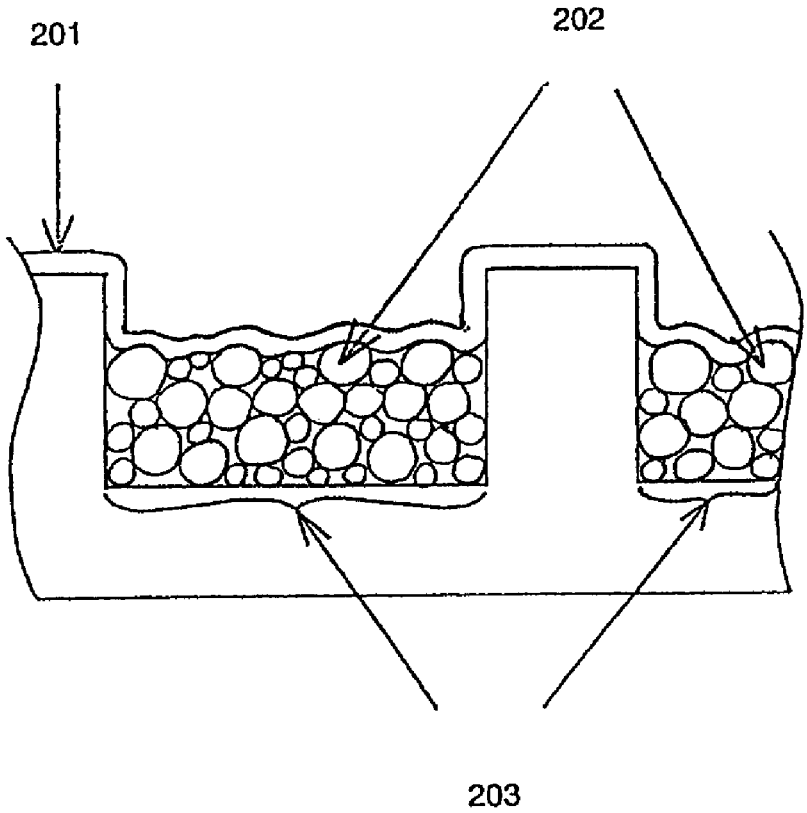
FIGURE 2 (PRIOR ART)
FIG. 2 is a section view showing in greater detail a conformal lacquer layer associated with prior art deposition methods.
Figure 3A:
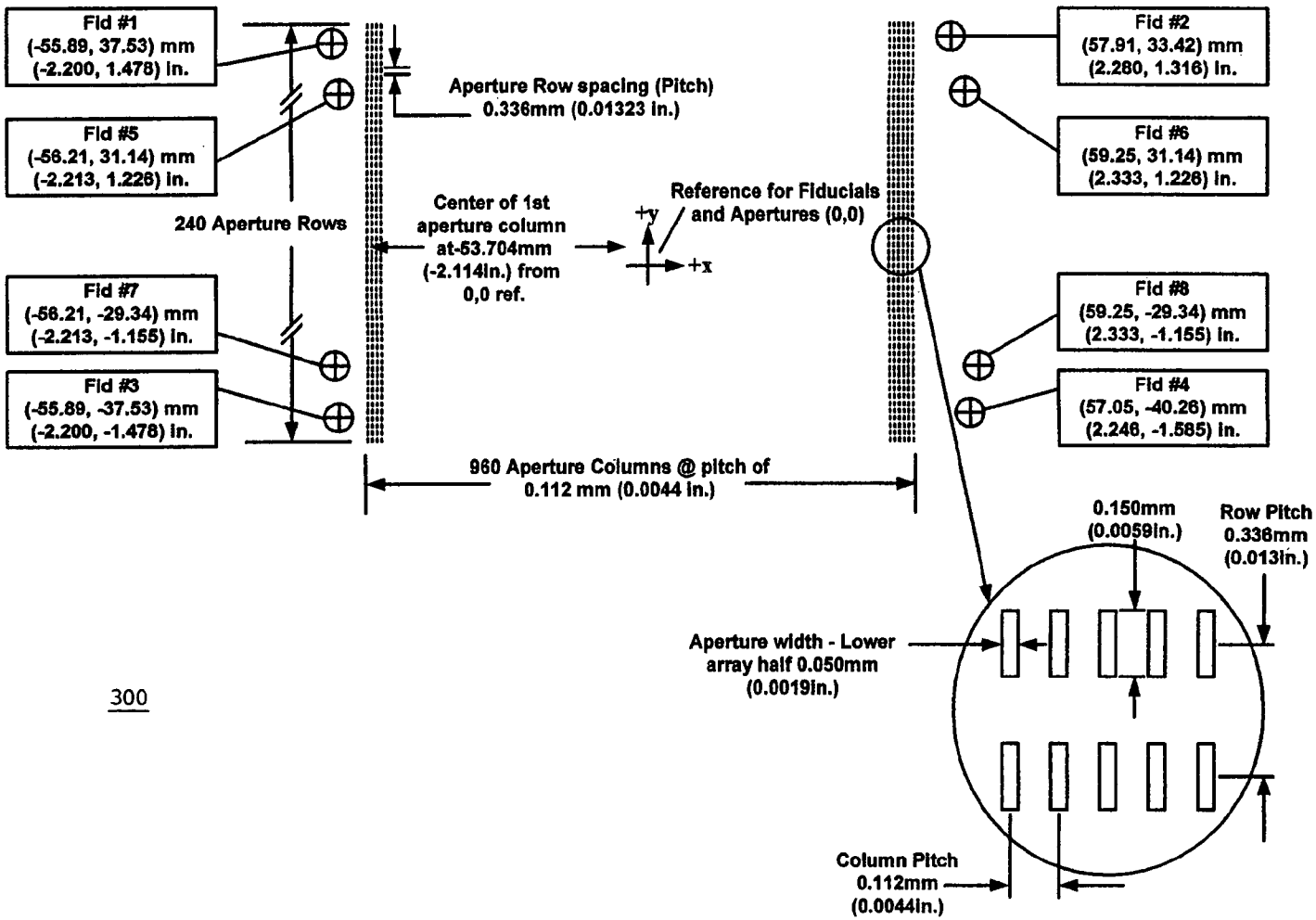
FIGS. 3A-B show a screen printing mask utilized in embodiments of the present invention.
Figure 3B:
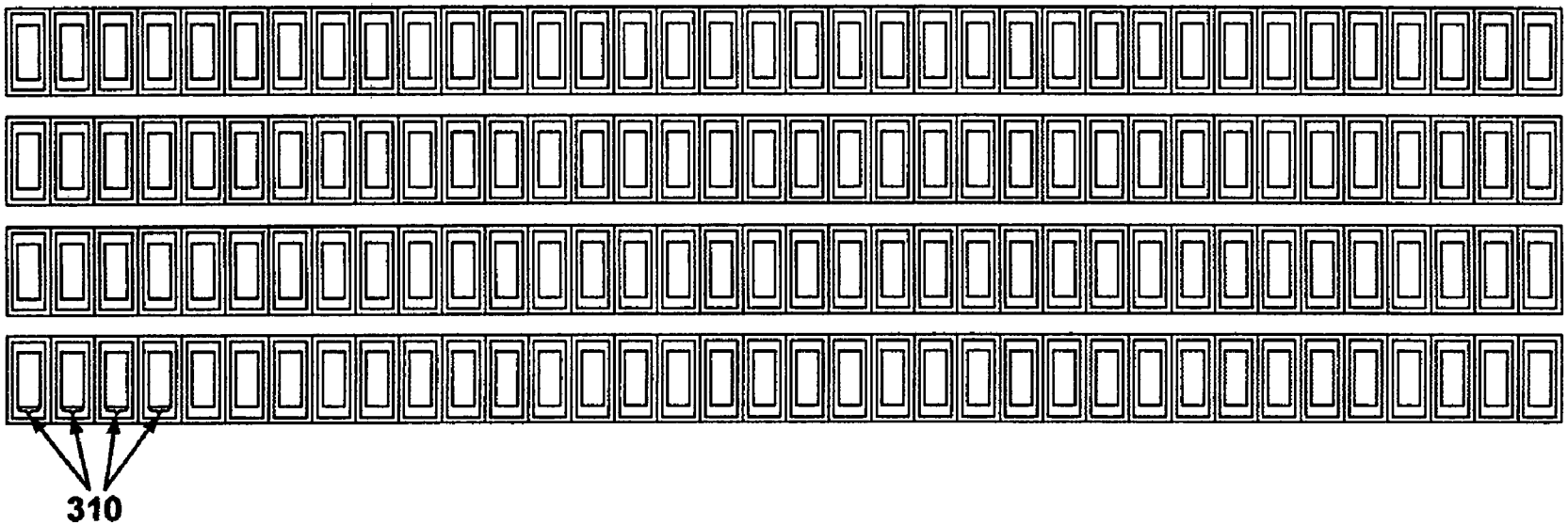

FIGS. 3A-B show a screen printing mask 300 utilized in embodiments of the present invention. FIG. 3A shows the general configuration of screen printing mask 300. In one embodiment, screen printing mask is a nickel plate foil approximately 0.05 mm (2 mil) thick. Screen printing mask 300 is centered above a faceplate of a display device and is precisely located utilizing eight fiducials, two in each corner. Each fiducial is 0.35 mm (0.0138 in.) in diameter. The fiducial locations are listed in FIG. 3A as coordinates which are measured from reference (0,0) located at the center of the aperture array.

There are a total of 240 rows and 960 columns for a total of 230,400 apertures. The apertures are 0.050 mm (0.0019 in) wide and 0.150 mm (0.0059 in) tall. The aperture spacing, or pitch, between aperture rows is, in the present embodiment, 0.336 mm (0.01323 in). The aperture spacing, or pitch, between aperture columns is 0.112 mm (0.0044 in). While the present embodiment recites these specific dimensions, the present invention is well suited to utilize screen printing masks of various sizes to facilitate fabrication of display devices of various dimensions.

FIG. 3B shows in greater detail the aperture configuration of screen printing mask 300 of FIG. 3A. In FIG. 3B, a plurality of apertures 310 are disposed in a grid pattern. Aperture 310 is configured in the size and shape approximating a sub-pixel of a display device, three of which comprise a pixel of a display device. The sub-pixel areas contain the phosphor rocks upon which a lacquer layer will be deposited.

Figure 4A:
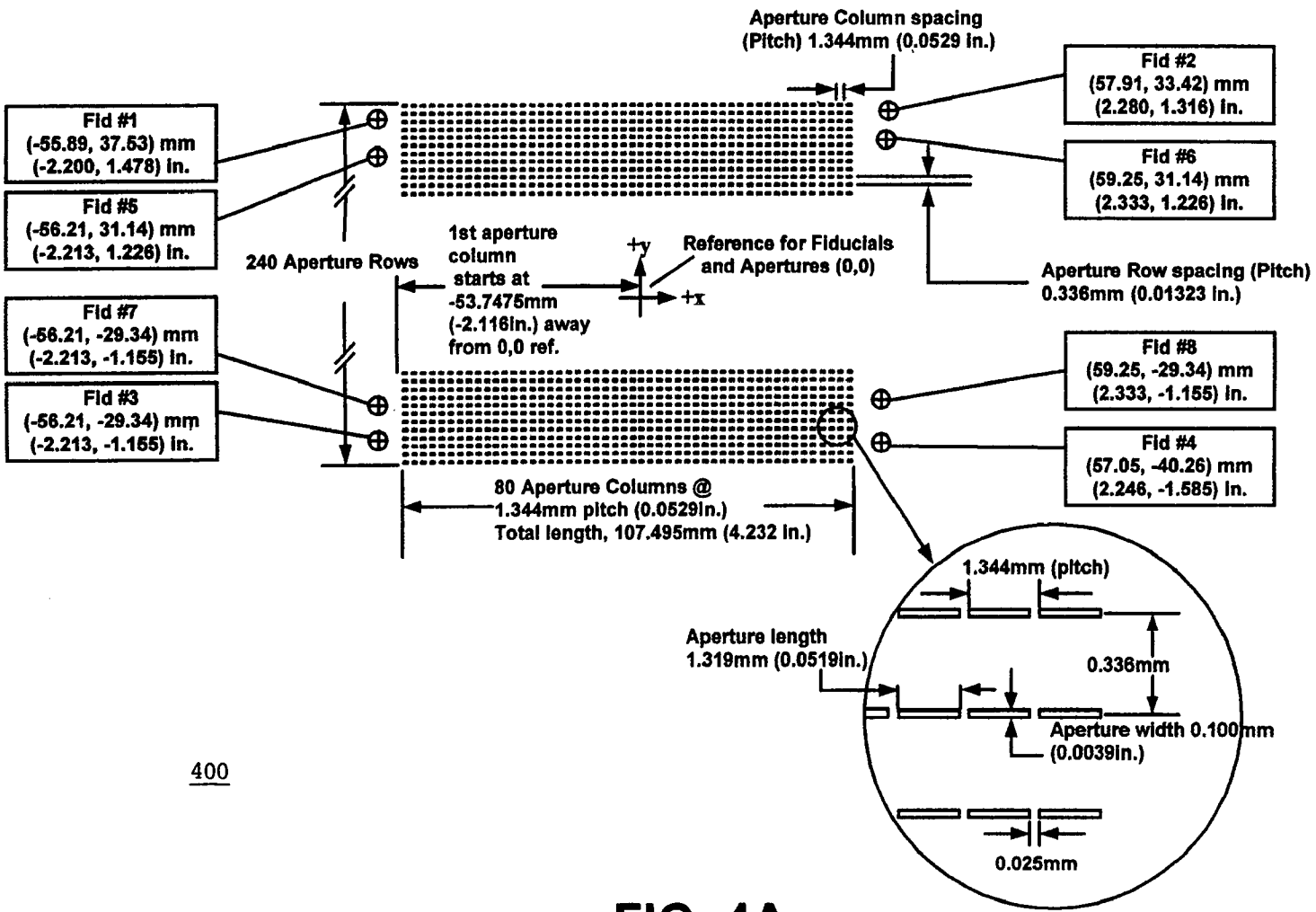
FIGS. 4A-B show a screen printing mask utilized in embodiments of the present invention.
Figure 4B:
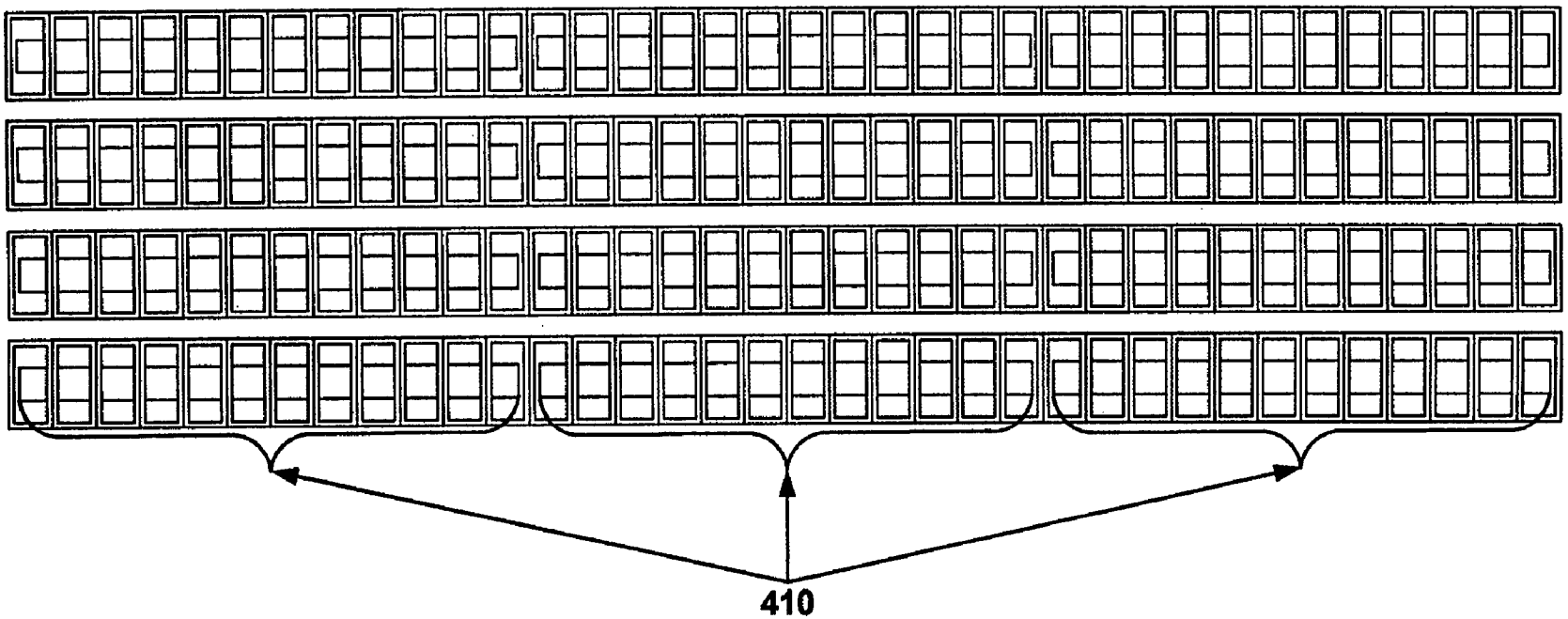

FIGS. 4A-B show a screen printing mask 400 utilized in another embodiment of the present invention. FIG. 4A shows the general configuration of screen printing mask 400. In one embodiment, screen printing mask 400 is a nickel plate foil approximately 0.05 mm (2 mil) thick. Screen printing mask 400 is centered above a faceplate of a display device and is precisely located utilizing eight fiducials, two in each corner. Each fiducial is 0.35 mm (0.0138 in.) in diameter. The fiducial locations are listed in FIG. 4A as coordinates which are measured from reference (0,0) located at the center of the aperture array.

There are a total of 240 rows and 80 columns for a total of 19,200 apertures in screen printing mask 400. The apertures are 0.100 mm (0.0039 in) wide and 1.319 mm (0.0519 in) tall. The aperture spacing, or pitch, between aperture rows is, in the present embodiment, 0.336 mm (0.01323 in). The aperture spacing, or pitch, between aperture columns is 1.344 mm (0.0529 in). While the present embodiment recites these specific dimensions, the present invention is well suited to utilize screen printing masks of various sizes to facilitate fabrication of display devices of various dimensions.

FIG. 4B shows in greater detail the aperture configuration of screen printing mask 400 of FIG. 4A. In FIG. 4B, a plurality of apertures 410 are disposed in a grid pattern. Aperture 410 is configured in the size and shape approximating a stripe of four adjacent pixel areas of a display device, with each pixel area comprised of three sub-pixel areas. The sub-pixel areas contain the phosphor rocks upon which a lacquer layer will be deposited.

Figure 5A:
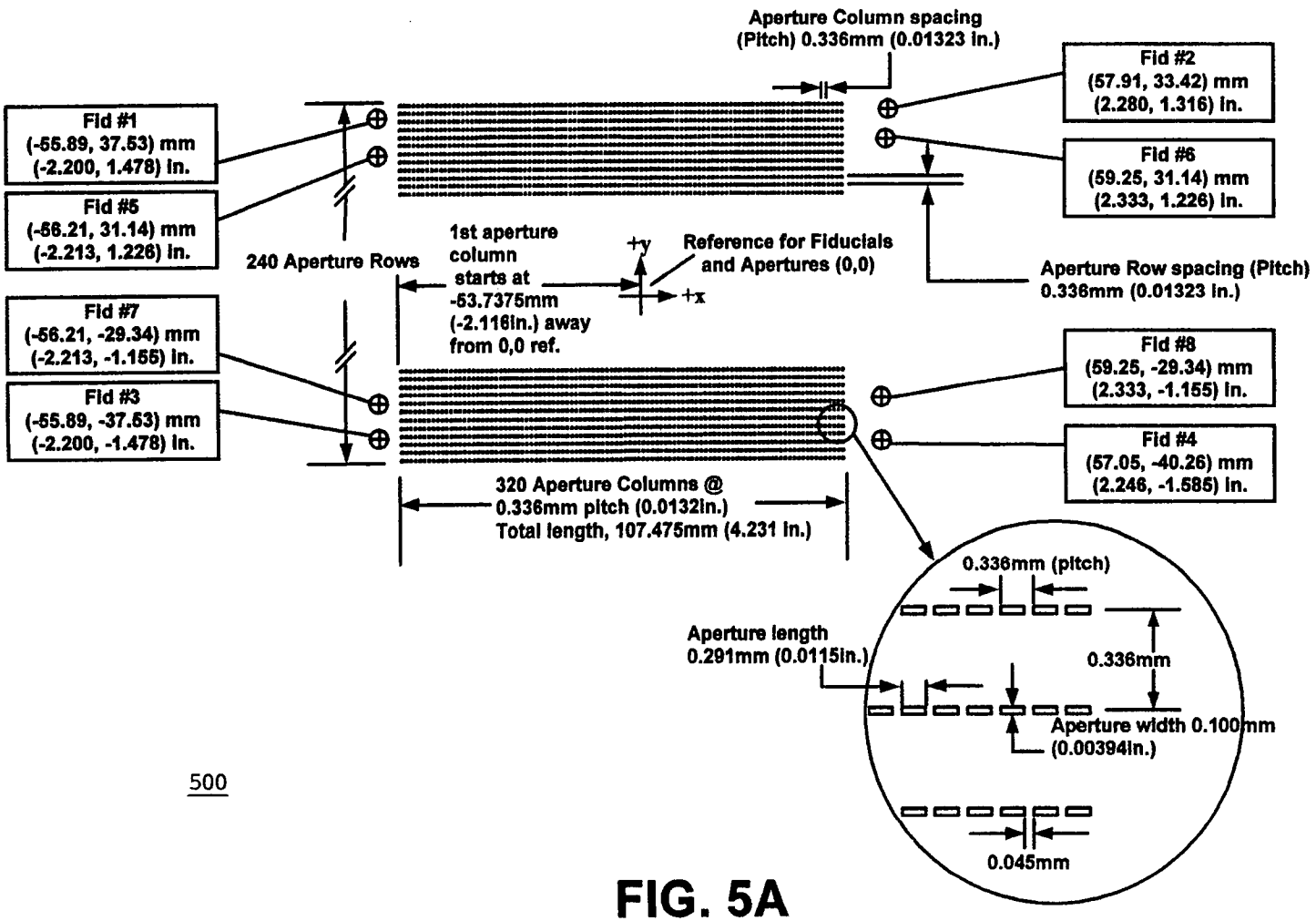
FIGS. 5A-B show a screen printing mask utilized in embodiments of the present invention.
Figure 5B:
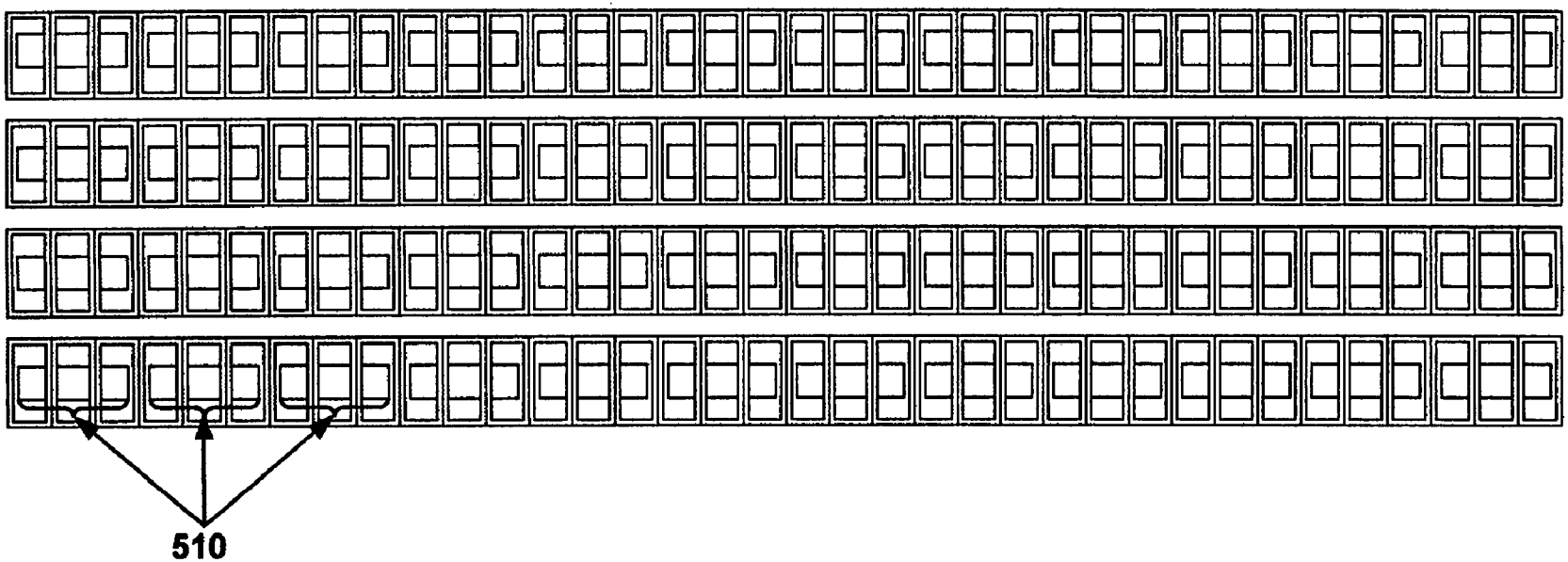

FIGS. 5A-B show a screen printing mask 500 utilized in another embodiment of the present invention. FIG. 5A shows the general configuration of screen printing mask 500. In one embodiment, screen printing mask is a nickel plate foil approximately 0.05 mm (2 mil) thick. Screen printing mask 500 is centered above a faceplate of a display device and is precisely located utilizing eight fiducials, two in each corner. Each fiducial is 0.35 mm (0.0138 in.) in diameter. The fiducial locations are listed in FIG. 5A as coordinates which are measured from reference (0,0) located at the center of the aperture array.

There are a total of 240 rows and 320 columns for a total of 76,800 apertures. The apertures are 0.291 mm (0.0115 in) long and 0.100 mm (0.00394 in) wide. The aperture spacing, or pitch, between aperture rows is, in the present embodiment, 0.336 mm (0.01323 in). The aperture spacing, or pitch, between aperture columns is 0.336 mm (0.01323 in). While the present embodiment recites these specific dimensions, the present invention is well suited to utilize screen printing masks of various sizes to facilitate fabrication of display devices of various dimensions.

FIG. 5B shows in greater detail the aperture configuration of screen printing mask 500 of FIG. 5A. In FIG. 5B, a plurality of apertures 510 are disposed in a grid pattern. Aperture 510 is configured in the size and shape approximating a pixel of a display device, each pixel being comprised of three sub-pixel areas. The sub-pixel areas contain the phosphor rocks upon which a lacquer layer will be deposited.

Figure 6:
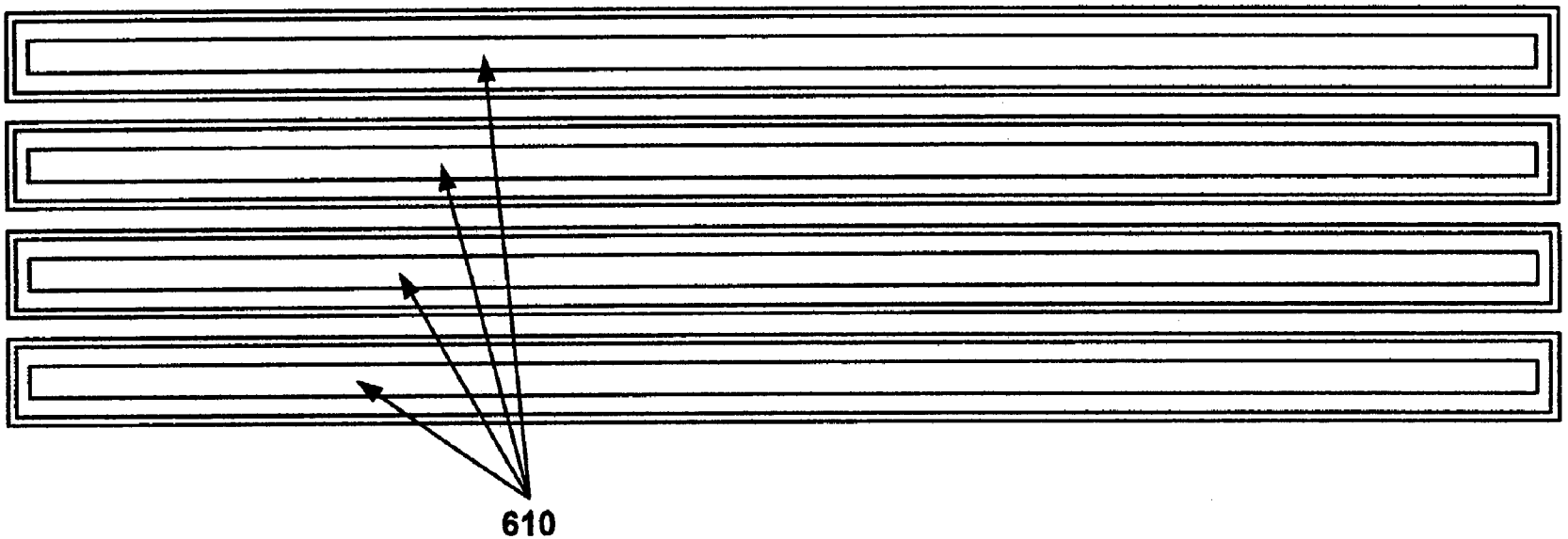
FIG. 6 shows a stripe aperture mask utilized in embodiments of the present invention.

FIG. 6 shows a portion of a stripe aperture screen printing mask 600 utilized in another embodiment of the present invention. In FIG. 6, a series of stripes 610 which are configured in the size and shape approximating an entire row of pixels of a display device.

Figure 7:
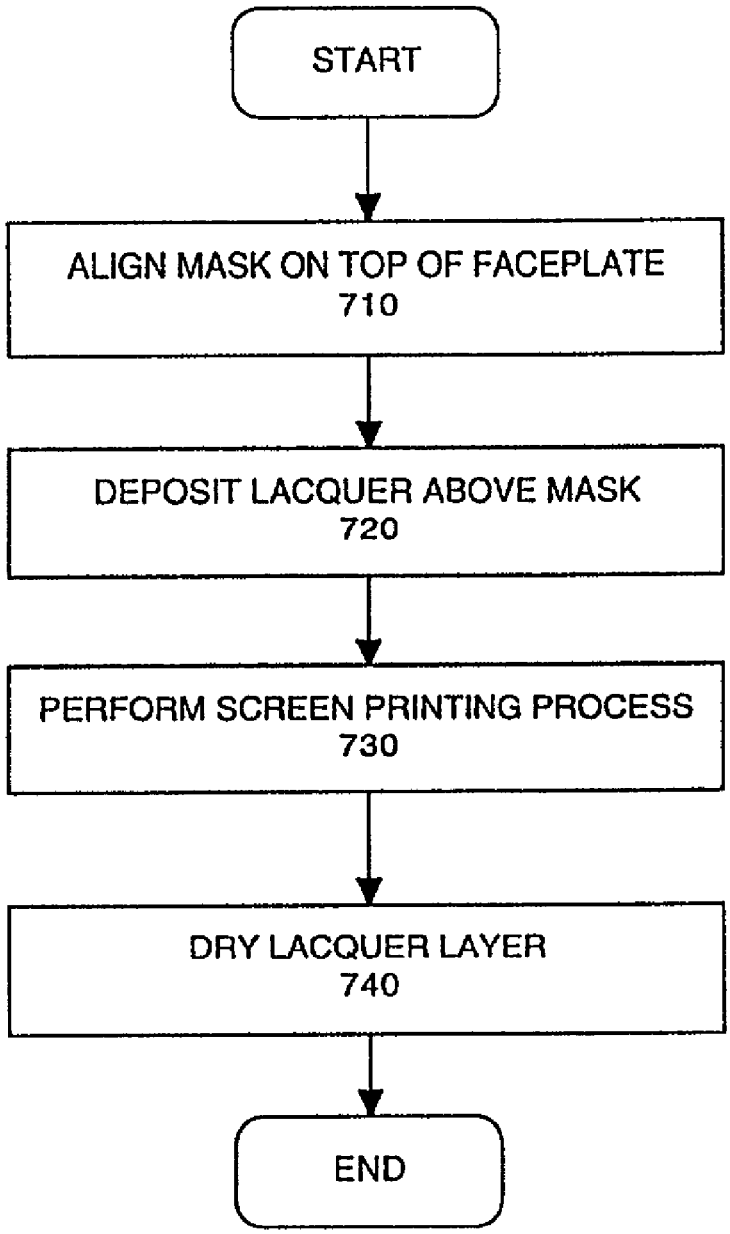
FIG. 7 is a flowchart of the steps in a process for depositing a lacquer layer in accordance with embodiments of the present invention.

FIG. 7 is a flowchart of a process 700 for depositing a lacquer layer in the fabrication of display devices in accordance with embodiments of the present invention. For purposes of clarity, the following discussion will utilize FIGS. 8A-D showing cross section views of a display device 800 in conjunction with flow chart 700 of FIG. 7, to clearly describe embodiments of the present invention. As will be described below, the present invention deals with a method for screen printed lacquer deposition in the fabrication of display devices.

Figure 8A:
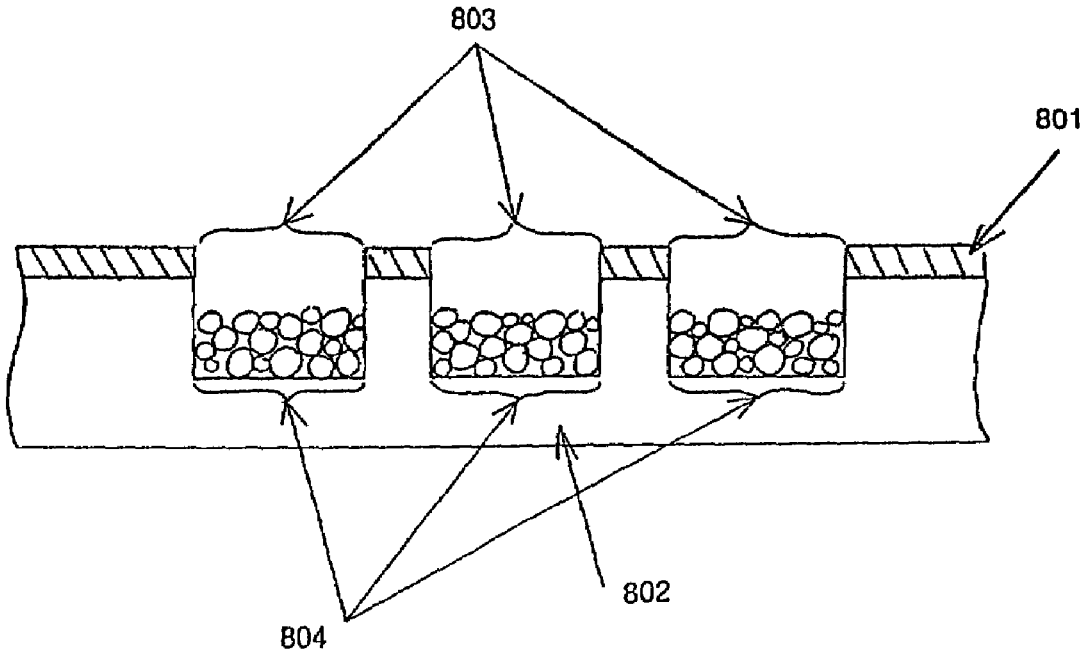
FIGS. 8A-D are cross section views of a display pixel area during a lacquer layer deposition as embodied by the current invention.

Referring to step 710 of FIG. 7 and to FIG. 8A, a mask 801 is aligned on top of a faceplate 802. In embodiments of the present invention, screen printing mask 801 (e.g., screen printing mask 300, 400, 500, and 600 of FIGS. 3, 4, 5, and 6 respectively) is aligned on top of a faceplate of a display device, using fiducial marks on mask 801 for precisely positioning the mask above the faceplate. Screen printing mask 801 has openings 803 which align with sub-pixel areas 804 within faceplate 802.

Figure 8B:
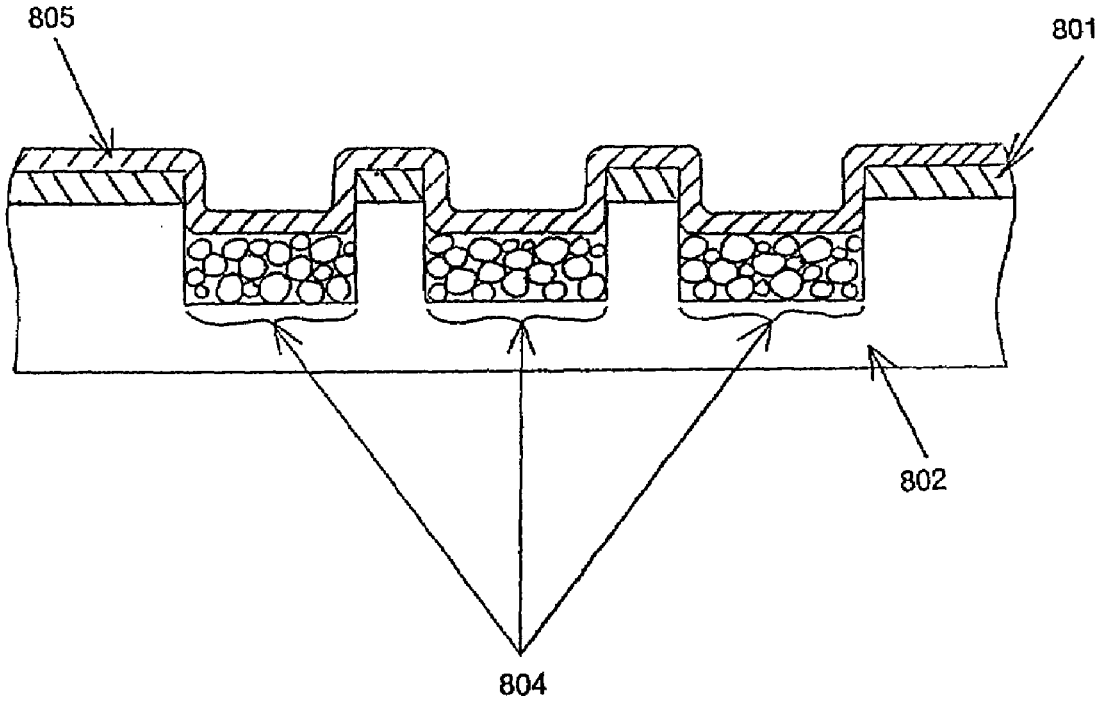

Referring to step 720 of FIG. 7 and to FIG. 8B, a lacquer material 805 is deposited above screen printing mask 801. In one embodiment, lacquer material 805 is sprayed upon screen printing mask 801.

In one embodiment, the lacquer material 805 is a low elongation lacquer which can create a non-conformal lacquer layer in sub-pixel areas 804 of faceplate 802. The advantage of utilizing a low elongation lacquer in the fabrication of a display device above the prior art is that a low elongation lacquer does not form a conformal layer upon the phosphor rocks in sub-pixel areas 804 of faceplate 802. This means that a non-conformal lacquer layer can be deposited which is not so thick as to cause tenting and bursting in the aluminum layer. This leads to a more uniform aluminum layer which reflects light to the phosphor rocks more evenly and facilitates a brighter, more efficient display device. Tests of the present invention show a 15% gain in efficacy over prior art display devices which used the float lacquer process. The float lacquer method relies upon high elongation lacquers which form a much more conformal lacquer layer and create an aluminum layer which reflects light photons less efficiently back toward the phosphor rocks.

Another advantage of the present invention is that lacquer material 805 is deposited into sub-pixel areas 804 and not on the rows and columns between the sub-pixel areas. The float lacquer process deposits lacquer across the entire surface of faceplate 802 and consequently into the rows and columns. Tenting of a subsequently deposited aluminum layer is a frequent problem, particularly when lacquer is deposited in the rows and columns between subpixels when the faceplate is later baked to remove solvents from the sub-pixels. The present invention, by selectively depositing lacquer material 805 only into the sub-pixel areas, is able to avoid this problem.

Figure 8C:
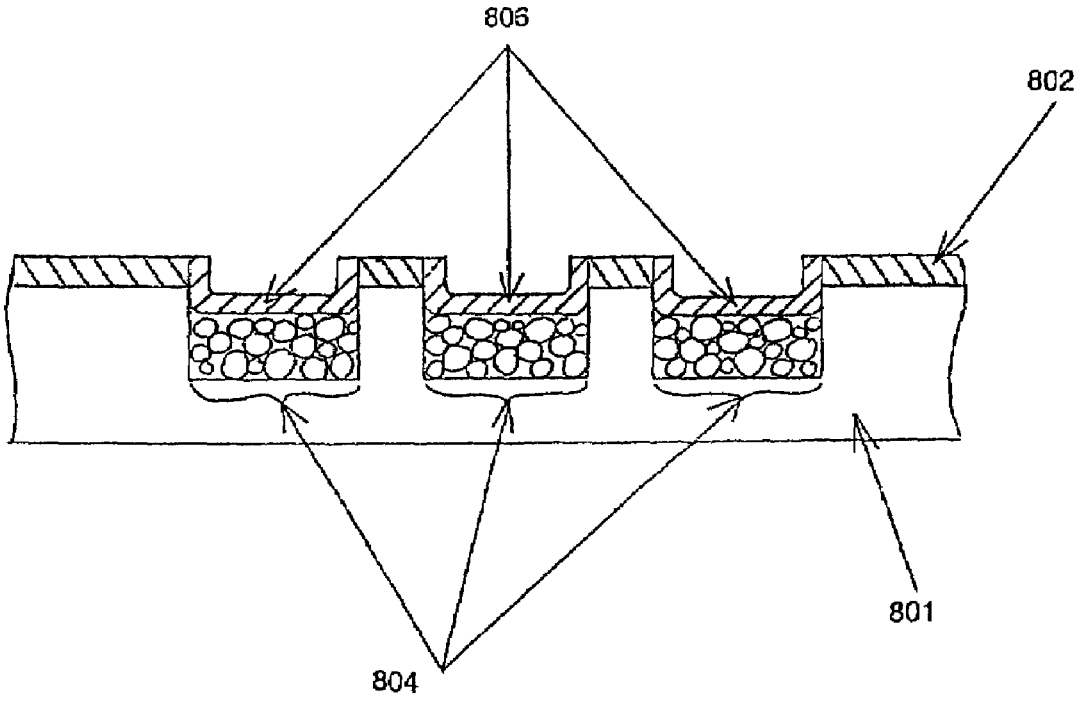

Referring to step 730 of FIG. 7 and to FIG. 8C, a screen printing process is performed. In one embodiment, excess amounts of lacquer material 805 are removed by drawing a blade across the top surface of screen printing mask 801. This has the added advantage of forcing lacquer material 805 into sub-pixel areas 804 and ensuring the deposition of a lacquer layer 806 upon the phosphor rocks in the sub-pixels.

Figure 8D:
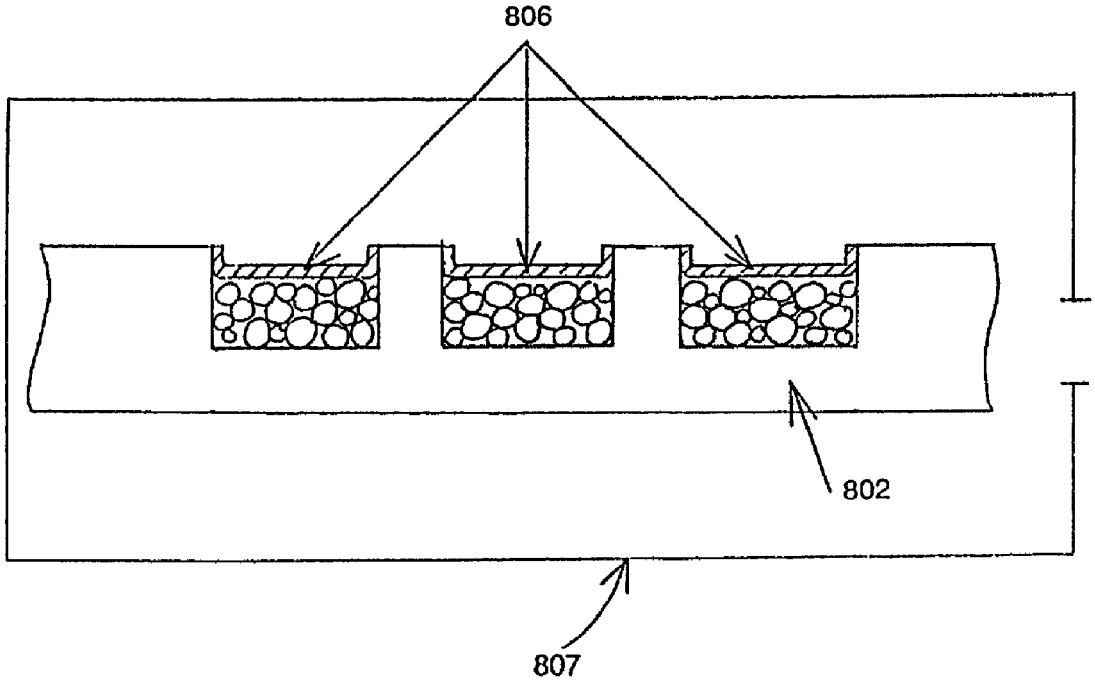

Referring to step 740 of FIG. 7 and to FIG. 8D, lacquer layer 806 is dried. Screen printing mask 801 is removed and faceplate 802 is placed in an chamber 807 to evaporate the lacquer formulation solvents of lacquer layer 806 through entanglements of macromolecules (e.g., cellulose, polyacrylates, polymethacrylates, and polyalkoxides) or by UV-curing (e.g., radical or cationic) and thus form an organic lacquer film. At this point, a non-conformal lacquer layer is ready for the deposition of an aluminum layer and faceplate 802 is ready for further fabrication.

The advantage to performing this evaporation step before depositing the aluminum layer is the possibility of tenting and rupture of the aluminum layer during a subsequent bake out is reduced. During the prior art bake out step, the aluminum layer could undergo tenting and even rupture as evaporated solvents from the solvent layer and lacquer layer exerted pressure upon the aluminum layer and occasionally ruptured it. In the present invention, these solvents are removed before the aluminum layer is deposited. When the faceplate undergoes a subsequent bake out to remove the remaining lacquer, far less material has to be evaporated and substantially less pressure is therefore exerted upon the aluminum layer.

Aside from the benefit of more precisely depositing the lacquer within the sub-pixels, the present invention is much quicker than the float lacquer process and more suitable for large scale manufacturing processes. One of the greatest disadvantages of using a float lacquer process is that excessive time is lost in waiting for the solvent in the tank to become still and flat prior to depositing the lacquer layer. This makes the float lacquer process uneconomical and unsuited to large scale manufacturing processes. If the solvent is not allowed to become still, the lacquer layer will be of non-uniform thickness which can cause an irregular aluminum layer. The present invention does not require this wait and does not require an intervening evaporation step prior to depositing an aluminum layer.

The present invention is a method for screen printed lacquer deposition in a display device which will not cause the aluminum layer to burst during the baking phase. Furthermore, the present invention, while meeting the above stated need, is applicable to large scale manufacturing processes.

The preferred embodiment of the present invention, a method for screen printed lacquer deposition for a display device, is thus described. While the present invention has been described in particular embodiments, it should be appreciated that the present invention should not be construed as limited by such embodiments, but rather construed according to the following claims.

What is claimed is:

1. A method for screen printed lacquer deposition for a display device comprising:

aligning a mask on top of a faceplate of said display device so as to cover rows and columns between sub-pixel areas of said display device, wherein said mask has an opening in a shape which corresponds to an individual sub-pixel area of said display device;

depositing a non-conformal lacquer material on said mask and into individual sub-pixel areas by spraying non-conformal lacquer material on said mask;

drawing a blade across the top surface of the mask to remove excess non-conformal lacquer material and to force non-conformal lacquer material into individual sub-pixel areas;

drying said non-conformal lacquer material; and depositing an aluminum layer upon said non-conformal lacquer material;

wherein drawing said blade is performed such that the non-conformal lacquer material is deposited on a phosphor material layer in each of the sub-pixel areas and, subsequent to being dried, the non-conformal lacquer covers inside walls of each of the sub-pixel areas from the phosphor material layer up to the top of the inside walls of each of the sub-pixel areas.

2. The method for screen printed lacquer deposition as recited in claim 1, wherein said drying of said non-conformal lacquer material comprises:

removing said mask;

placing said faceplate into a chamber; and evaporating a solvent in said non-conformal lacquer material.

* * * * *